United States Patent [19]

Benoit et al.

[11] 4,094,024

[45] June 13, 1978

[54] SYSTEM FOR CONTROLLING RELATIVE MOVEMENT OF PORTIONS OF A BED

[75] Inventors: Roland A. Benoit, Danielson; Edmund Guillot, Putnam, both of Conn.

[73] Assignee: InterRoyal Corporation, New York, N.Y.

[21] Appl. No.: 718,507

[22] Filed: Aug. 30, 1976

[51] Int. Cl.[2] ..... A61G 7/10

[52] U.S. Cl. ..... 5/66; 5/68; 192/48.9; 192/93 B

[58] Field of Search ..... 5/60, 63, 66, 67, 68; 318/65, 103, 227; 340/52 E

[56] References Cited

U.S. PATENT DOCUMENTS

| | | | |
|---|---|---|---|
| 3,198,891 | 8/1965 | Burst et al. | 5/68 |
| 3,839,753 | 10/1974 | Benoit et al. | 5/68 |
| 3,913,153 | 10/1975 | Adams et al. | 5/68 |

*Primary Examiner*—Casmir A. Nunberg
*Attorney, Agent, or Firm*—Arthur A. March

[57] ABSTRACT

System for controlling selective relative positional movement of portions of a bed structure with respect to a main supporting bed base frame, such as in a hospital bed, in which a single common motor controllable, e.g. by suitably actuatable switch means, for driving operation selectively in alternative forward and reverse directions is utilized, and which contemplates a plurality of independently operable individual motion transmission means connectable to such bed structure portions for correspondingly effecting the selective relative positional movement thereof with respect to the main supporting bed base frame, e.g. for head, knee and high-low adjustments of the bed, plus common drive transmission means connected to the common motor for corresponding operation thereby in such directions for driving in turn the motion transmission means, coupling means actuatable for operatively coupling and uncoupling the individual motion transmission means with the common drive transmission means, and common uniselective control means operatively connected to the coupling means for uniselectively actuating the coupling means for coupling the common drive transmission means with a selective individual motion transmission means and for simultaneously preventing the coupling of the common drive transmission means with the remaining corresponding motion transmission means, whereby to control such selective relative positional movement, preferably with remote override control means arranged operatively for selectively preventing the actuating of the coupling means by the common uniselective control means and for independently selectively controlling the actuation of the coupling means.

11 Claims, 12 Drawing Figures

FIG.1
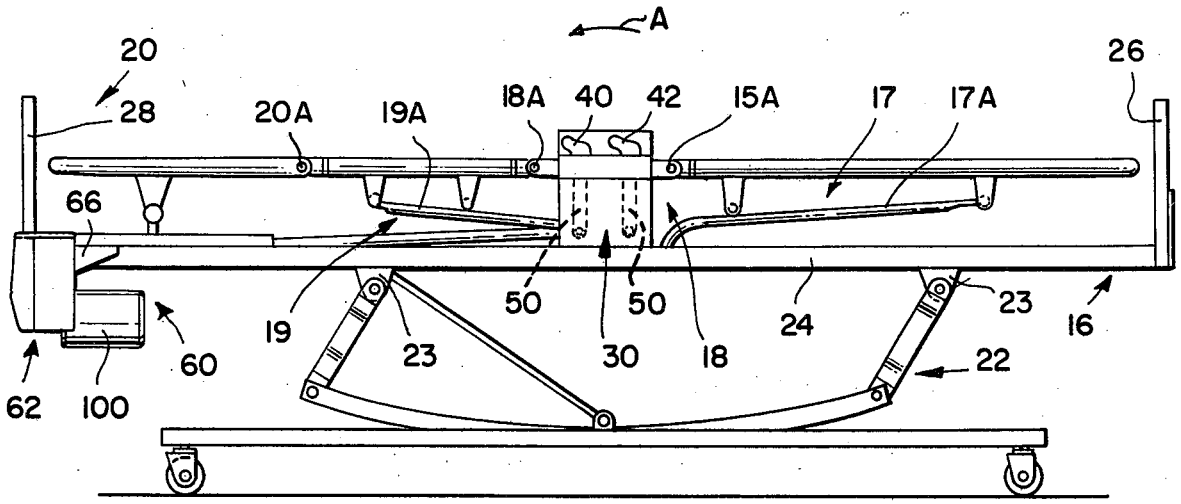
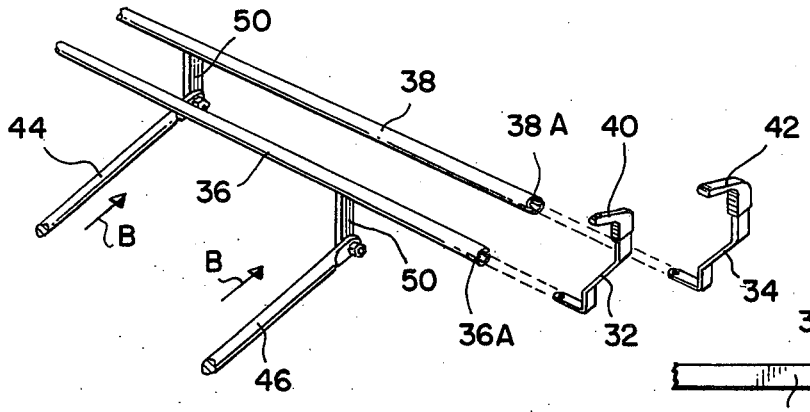
FIG.2
FIG. 3
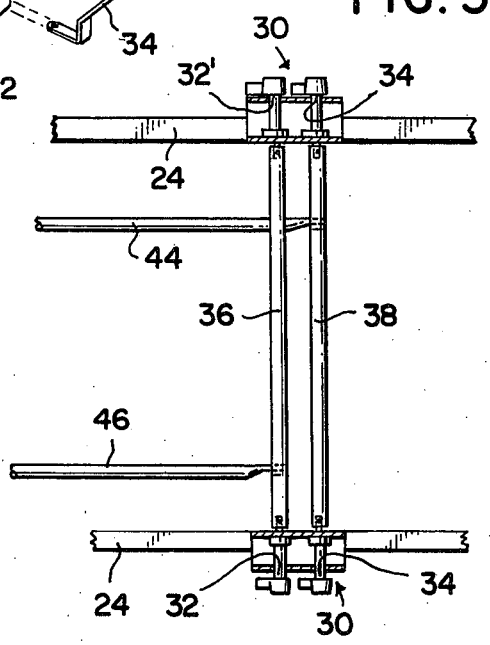

70A
72
68
68A
70

74
111
70
68
68A
120
118
110
112
70A
122
64B
64A
64

64B
64
74
64 A
110
111
112
120
116
72
122
68
70
70A
68A
74

24
62
118
68
74
130
68
5
74
116
100
111
5
68
24

SYSTEM FOR CONTROLLING RELATIVE MOVEMENT OF PORTIONS OF A BED

FIELD OF INVENTION

This invention relates to improvements in beds and more particularly to hospital beds which are adapted to accomplish the well-known contour positions and movements to high and low position as well as shock and drainage positions.

BACKGROUND OF INVENTION

In the prior art, there had been suggestions for many beds having automatic controls for adjusting the bed to several positions which are disposed within reach of the patient for self adjustment. However, until a short time ago, means were not provided by which these controls could be rendered inoperative under certain contains while making operative similar controls located at remote positions which were inaccessible to the patient. Many situations arise in the course of hospital activity in which it is highly desirable to eliminate the possibility of a patient controlling the positions which a bed may assume.

A few years ago, however, a very effective control arrangement was presented in United States Letters Patent Number 3,839,753 in which extremely reliable and operative means were provided for preventing the operation of or "locking out" the controls located in proximity to the patient's manipulation area while making operative controls for adjusting the positions of the bed located in a remote area. This patent has shown structure which is a great advance over the prior art theretofore known and was a very satisfactory arrangement. The structure presented by this prior art patent, however, utilized a separate motor for each control which governed the various positions assumed by the bed. This structure was, of course, relatively expensive and while quite dependable, contributed to the cost of the bed.

SUMMARY OF THE PRESENT INVENTION

The present invention provides a unique and novel arrangement which has controls in the immediate vicinity of the patient for adjusting various positions of the bed which can be "locked out" by a remote control which thereupon takes over the adjusting operations but with only one power unit operating the entire range of adjustment features.

By the structure presented, one motor or power supplier may be used to activate the controls for the various contour positions of the bed and for attaining the high, low and intermediate height of the frame of the bed.

In addition, the present invention provides means in the form of a cable tension adjusting unit whereby operation of the several drive operating means of the adjustment of the positions of the bed structure is limited to one operation at a time when actuated. This cable acts as an interlock for the attainment of only one desired position. Furthermore, the present invention provides a rotatable simple lock out control which is pivotally mounted whose arrangement prevents any accidental locking or unlocking position when such position is not desired.

BRIEF DESCRIPTION OF THE DRAWINGS

In the drawings:

FIG. 1 is a side elevational view of the bed structure in accordance with the present invention.

FIG. 2 is a perspective view of the manual means adapted to control all desired positions of the bed structure as regards contour adjustment.

FIG. 3 is a top plan view of the manual control means as they are arranged on the bed structure.

DETAILED DESCRIPTION OF THE INVENTION

Figures 4, 5, 6, 7:
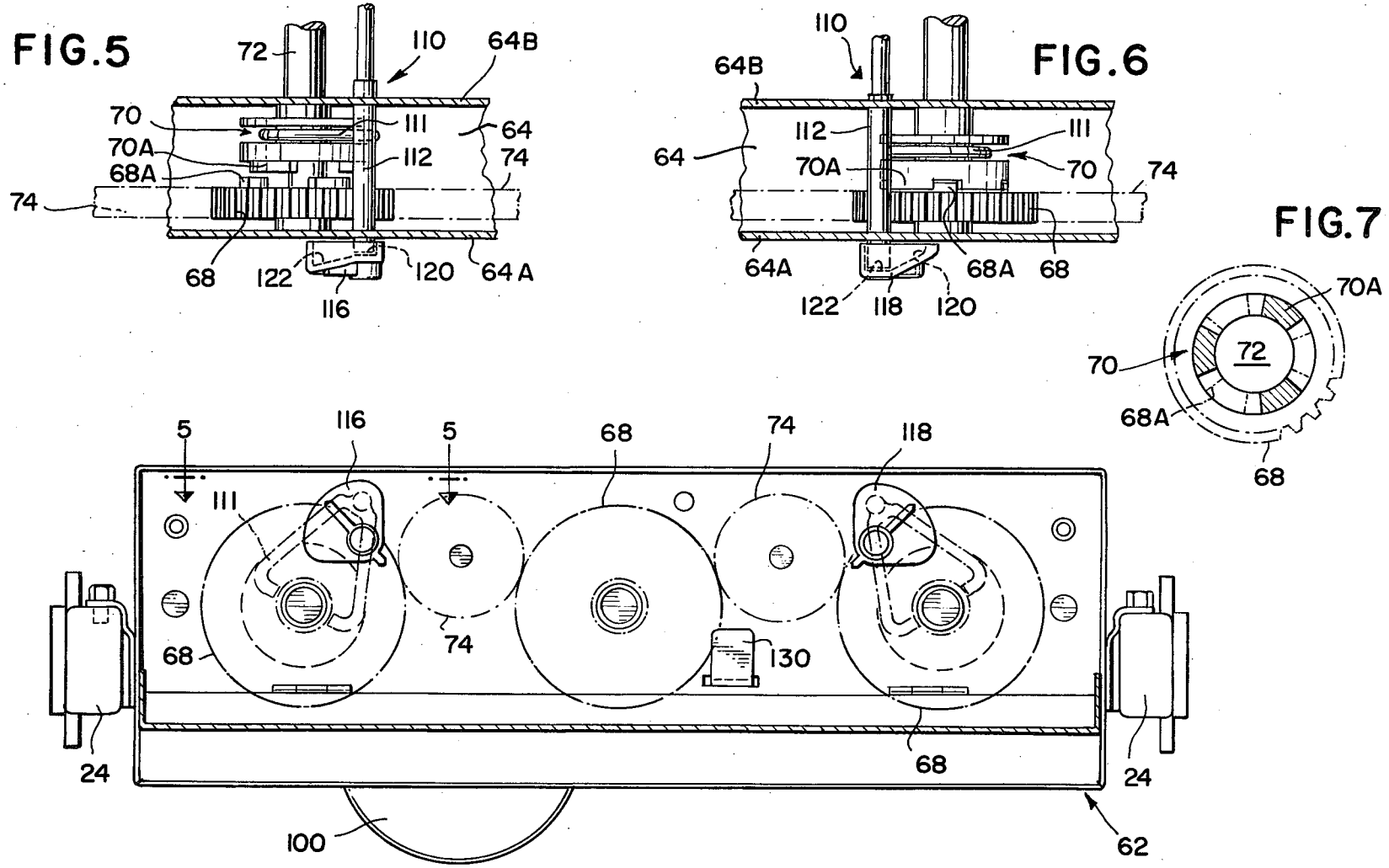
FIG. 4 is a front elevational view of the remote nurse console located at the foot of the bed structure. The access door of the nurse console has been broken away to show the different control components.
FIG. 5 is a partial cross sectional view taken along line 5—5 of FIG. 4 showing the clutching device in its inoperative position.
FIG. 6 is a view similar to FIG. 5 showing the clutching device in its operative position.
FIG. 7 is a diagram showing the relationship between the clutch device and a drive gear.

The drawings which illustrate one preferred embodiment of the present invention show a structure comprising a plurality of articulated sections including a head section 16, a middle section 18 and a foot section 20. The sections are pivotally connected at pivot points 15A, 18A and 20A so that the sections may move with relation to each other in relative contour positions through a vertically moveable drive assembly comprising a head section lifting means 17 and a foot or knee section lifting means 19.

There is a supporting parallelogram structure 22 which carries a moveable frame 24 which is adapted to be moved to extreme high and low positions and various positions in between. The articulated sections 16, 18 and 20 are mounted on this elongated rectangular frame 24, preferably such that section 18 is stationarily fixed thereto. The parallelogram structure is described in detail in United States Letters Patent No. 3,839,753. A headboard 26 and a footboard 28 are arranged in the usual manner at the opposite ends of the structural frame 24.

For ready access by and availability to a patient confined to the bed, there is provided an adjustment control console 30 which is disposed somewhere intermediate and close by the frame 24. The console 30 includes control levers 32 and 34 which are operatively engaged with horizontally disposed transverse tubings 36 and 38 which are connected to the control levers and extend across frame 24. The control levers are provided with manipulative handles 40 and 42 which are disposed within the reach of the patient in the bed, e.g. at middle section 18. For convenience, a similar structural arrangement of control levers 32' and 34' is provided on the side of the bed opposite to the side bearing control levers 32 and 34 as is illustrated in FIG. 3. Tubes 36 and 38 are provided with link arms 50,50 which are pivotally connected to connecting rods 44 and 46, respectively.

The lifting mechanism 17 for head section 16 comprises a push-pull arm 17A which is pivotally connected to an elongate outer tubing 17B suitably connected to frame 24 for relative back and forth movement with respect thereto, and an elongate drive screw 17C which is in the usual manner threaded at one end into a nut (not shown) which is fixed within the adjacent end of tubing 17B. The drive screw 17C extends in a longitudinal direction along and is rotatably supported on frame 24, with the other or gear-driven end thereof extending through transverse member 24A. The lifting mechanism 19 for foot section 20 comprises a push-pull arm 19A which is pivotally connected to an elongate outer tubing 19B similarly connected to frame 24 for such relative back and forth movement, and an elongate drive screw 19C is threaded at one end into a nut (not shown) fixed within the adjacent end of tubing 19B. The drive screw 19C extends in a longitudinal direction along and is rotatably supported on frame 24, with the other or gear-driven end thereof extending through transverse member 24A.

The elongate rectangular frame 24 is adapted to be raised or lowered horizontally by means of the operation of the parallelogram structure 22 which as aforesaid is described and explained in U.S. Pat. No. 3,839,753. The high and low positions of the elongate rectangular frame 24 are achieved by a similar mechanism comprising moveable elongate tubing 23A mounted on the drive screw 25 and suitably connected to the frame 24 for relative back and forth movement with respect thereto. As the drive screw 25 is turned, the elongate tubing 23A is moved either toward or away from the footboard 28 which causes the parallelogram support structure 22, operatively connected via the appropriately positioned spaced ears 23 to elongate tubing 23A, to fold or expand and thereby lower or raise the frame 24.

While the head and foot or knee mechanisms 17 and 19 can be controlled by the patient at console 30 for contour adjustment, the high and low adjustment of the bed frame 24 for safety reasons advantageously can only be controlled by the nurse or other attendant at the remote nurse control console 62, e.g. at the foot of the bed, below the frame 24.

A power drive unit or motor 60 is also disposed beneath the frame 24 at the foot section 28. The power drive unit 60 comprises a transmission clutch and gear housing 64 having front and rear lateral walls 64A and 64B respectively. A cam support member 66 is welded to the rear lateral wall 64B and extends perpendicularly therefrom. A plurality of drive gears 68 and clutch plates 70 are mounted on shafts 72 supported between the front and rear walls 64A and 64B within the gear housing 64. Idling gears 74 are provided between the drive gears 68 and are mounted on shafts 76 which are also supported between the front and rear walls 64A and 64B of the gear housing 64.

Figure 8:
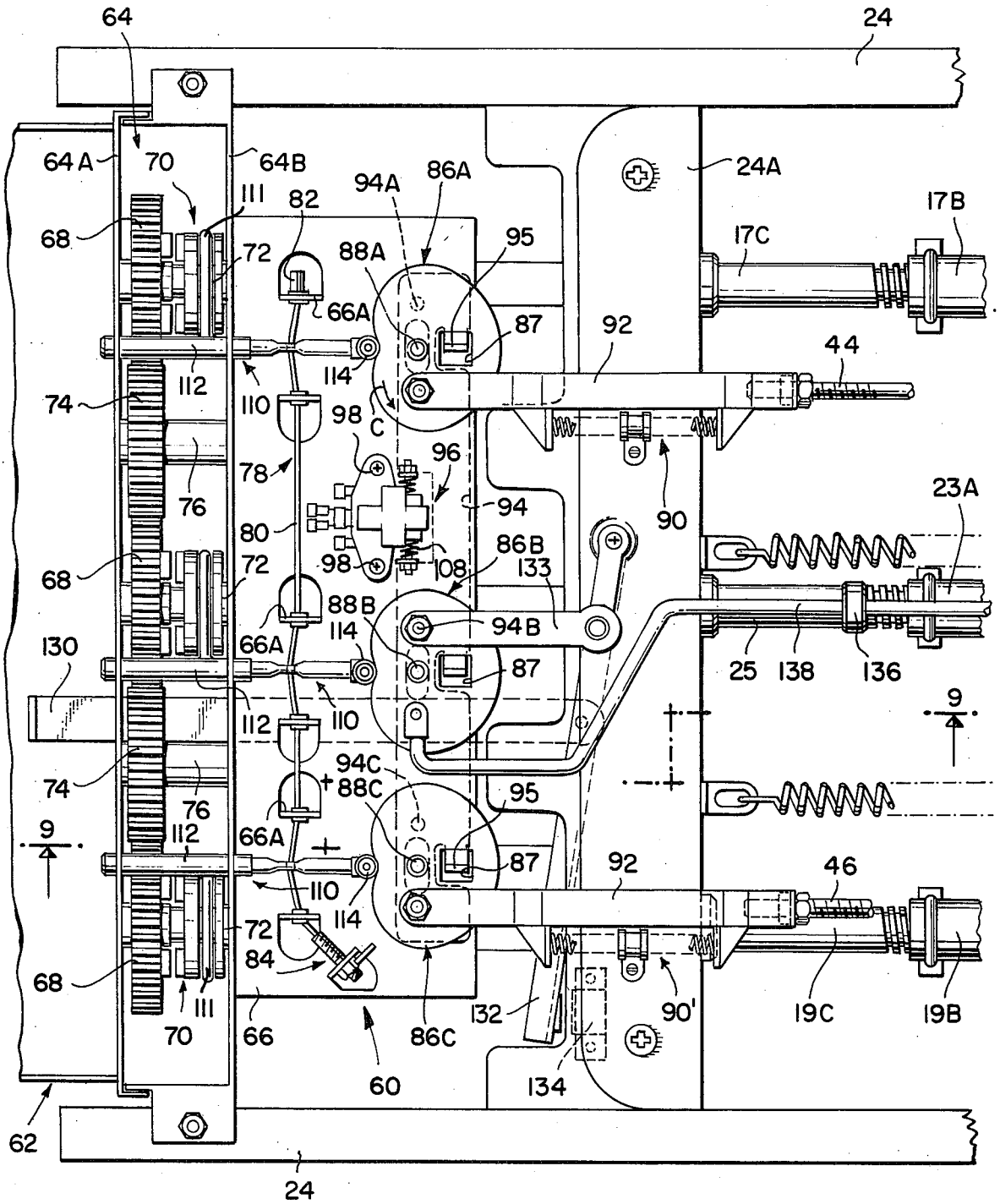
FIG. 8 is a partial top plan view of the transmission control unit which is located remote from the patient but operatively associated with the manual means adjacent thereto.

In accordance with the present invention as one of the features thereof, the engagement of more than one drive mechanism at a time is prevented. This accomplishment insures the fact that there is a positive drive for accomplishing one position which cannot be interfered with by any other drive mechanism attempting to attain another position. This is important in connection with the adjustment of hospital beds as movement to a non-prescribed position or simultaneous movement of two such adjustment mechanisms may be very detrimental to the condition of the patient. For this purpose, safety means 78 are provided. These safety means comprise a cam support member 66 which is provided with a plurality of aligned tab members 66A spaced apart from each other. A non-extensible selective fixed length cable 80 is extended through tabs 66A and is tensioned between stop 82 and a tension adjustment device 84 to achieve the desired conjoint length and tension condition for cable 80. A plurality of cams 86A, 86B and 86C are pivotally mounted on the upper surface of support member 66 through pins 88A, 88B and 88C respectively. Each cam is provided with an opening 87 therethrough. Individual rotation of cams 86A and 86C is accomplished by the activating rods 44 and 46 operatively connected to levers 32 and 34 respectively. Cam activating rods 44 and 46 are disposed as shown in FIG. 8, to maintain cams 86A and 86C in neutral position. This is accomplished through an equalizer spring assembly (90—90') interposed between connection brackets 92 and cam activating rods 44 and 46 respectively.

Figure 11:
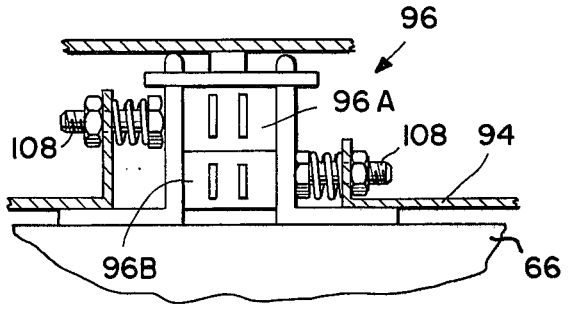
FIG. 11 is an elevational view of the switching means adapted to control the individual drive means.

A slide bar 94 having projection tabs 95 is slidably supported on member 66 which is operatively connected to each individual cam 86A, 86B and 86C through pins 88A, 88B and 88C respectively. The projecting tabs 95 of slide bar 94 project through opening 87 of cams 86A, 86B and 86C whereby rotation of any one cam will impart a sliding movement to the slide bar 94. Within the path of the slide bar 94, forward and reverse motor switch means 96 are disposed which are there secured to the support member 66 through screws 98 as shown in FIGS. 8 and 11.

Figure 10:
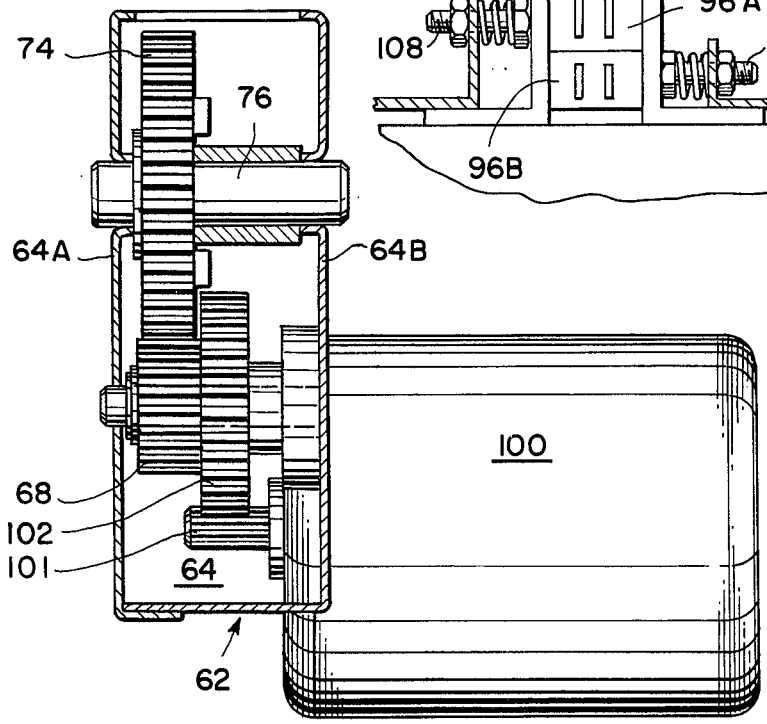
FIG. 10 is a cross sectional view taken through an idle gear which forms part of the gear transmission unit.

As clearly evident from FIG. 10, the present invention provides a single unitary motor 100 which is supported by the gear housing 64 and is operatively connected to drive gear 68 through reduction gear 102. This one motor is the only power means for the drive to attain the movement and positioning of the head section 16 and foot or knee section 19. This motor also is the only power unit for achieving the high and low positions of the frame 24 of the bed. It will be understood that the savings accomplished by this unique and novel arrangement are highly desirable in cost conscious hospitals and the like.

Figure 12:
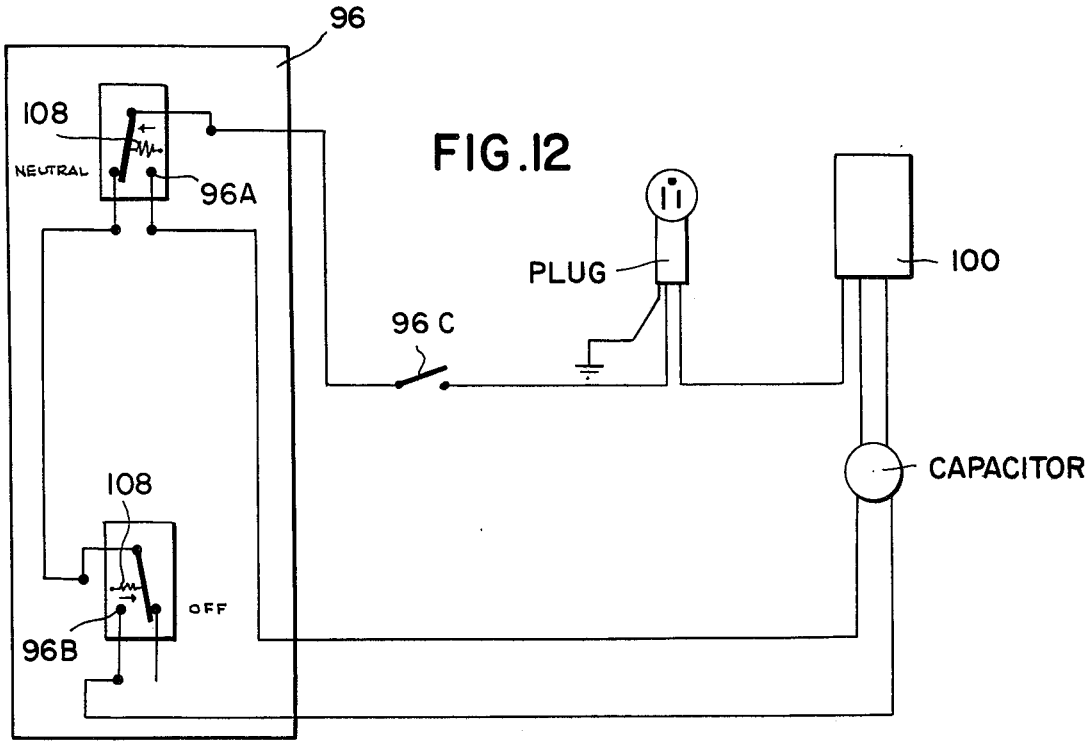
FIG. 12 is a simplified wiring diagram of the controlling unit.

The energization of the motor 100 through the contacts 96A and 96B of the motor switch 96, the simplified conventional circuitry of which is shown rudimentarily in FIG. 12, causes the motor shaft 101 to turn and effect the movement to accomplish the above described operations and positioning of the bed frame and sections. Specifically, upon closing the master safety switch 96C, the activation of motor switch 96 from neutral or off position to contact 96A or 96B as slide bar 94 is appropriately displaced by manual action will cause rotation of the motor in either a clockwise or counterclockwise direction, as the case may be, for corresponding forward and reverse operation of the adjustment mechanism selected.

As shown in FIG. 8, each cam 96A, 86B and 86C is operatively associated with a yoke assembly 110 mounted across the frame 64. This yoke assembly has a spring loaded stem 112 and a roller 114 disposed at one end thereof which is in contact with the peripheral area of the associated cam 86A, 86B or 86C, as the case may be.

The cable 80 is also threaded through a bore in each of the stems 112 and tabs 66A in such fashion that rotation of any one of the cams 86A, 86B and 86C will impart a consequent sliding motion to the associated yoke assembly 110 causing the cable 80 to move slightly thereat to an offset or deformed path position.

In accordance with the present invention, the cable 80 has a selectively predetermined and well defined relatively non-extensible and substantially fixed length and serves as a flexible linear tension adjustment element stationarily arranged in a normal straight path so as to permit limited flexing out of its normal path to an extent corresponding to the limited range actuating displacement of only one stem 112 of a given yoke assembly 110. As a consequence, only one drive movement can be accomplished at any one time. This arrangement provides for the safety features noted hereinabove.

The sliding movement of the particular yoke 110 in turn causes the associated clutch plate 70 to connect with the drive gear 68 through meshing serrations 68A and 70A. The mechanical connection is established by means of a fork 111 welded to the control assembly 110.

In order to prevent the patient from operating the controls by manipulation of control levers 32 and 34 within the scope of the patient's reach, remote override or lock out means are provided at console 62. These lock out means comprise control knobs 116 and 118 which have a restricted area of operation 120 and an enlarged area of operation 122. The restricted area limits or prevents the actual movement of the pertinent yoke 110 while the enlarged area allows the actual movement of the yoke 110 to occur, thereby enabling the drive gear 68 and the clutch plate 70 operationally to engage or couple with one another to impart rotational movement to a particular one of the drive screws 17C and 19C, depending upon the movement of the respective control levers.

Suitable slip clutch connections (not shown) of the conventional type are operatively disposed between drive screws 17C and 19C and their appropriate drive gears 68, respectively, to prevent damage to or jamming of the interconnected parts when the head and foot sections reach their limiting positions, as the case may be, and before motor 100 is deenergized by return of levers 32 and 34 to their inactive or neutral position.

The high and low positions of the bed as well as all intermediate positions therebetween are achieved through remote control lever 130 which is located in the nurse console 62. Control lever 130 is operatively connected to a cam control linkage 132 which is pivotally mounted on transverse member 24A and in turn pivotally linked via link 133 at 94B to cam 86B, so that push-pull movement of control lever 130 causes opposite relative movement of connecting rod 138.

A magnetic catch 134 maintains cam 86B in appropriate inward position when control lever 130 is moved to push or down position for performing the downward movement of the frame 24 until such time as the travel of the elongate tubing 23A (to the right as viewed in FIG. 9) is arrested by contact of friction guide member 140 with the appropriate stop member 136 and in turn movement of connecting rod 138 sufficiently to return cam 86B to neutral position. This automatically opens switch 96 and deenergizes motor 100.

On the other hand, when control lever 130 is moved to pull or up position, reverse rotation of cam 86B causes switch 96 to energize motor 100 to move elongate tubing 23A (to the left as viewed in FIG. 9) to raise the frame 24 until friction guide member 140 contacts the other stop member 136 amd causes connecting rod 138 to move sufficiently to return cam 86B to neutral position. Again, this automatically opens switch 96 and deenergizes motor 100.

The stops 136 are spaced from each other a selective high and low range limiting distance and in such manner that guide member 140 located at the adjacent end of the elongate tubing 23A moves pullingly along connecting rod 138 in frictional sliding engagement therewith until it contacts the appropriate stop 136 in the direction of its longitudinal movement and causes switch 96 to deenergize motor 100 when frame structure 24 assumes the desired position.

Figure 9:
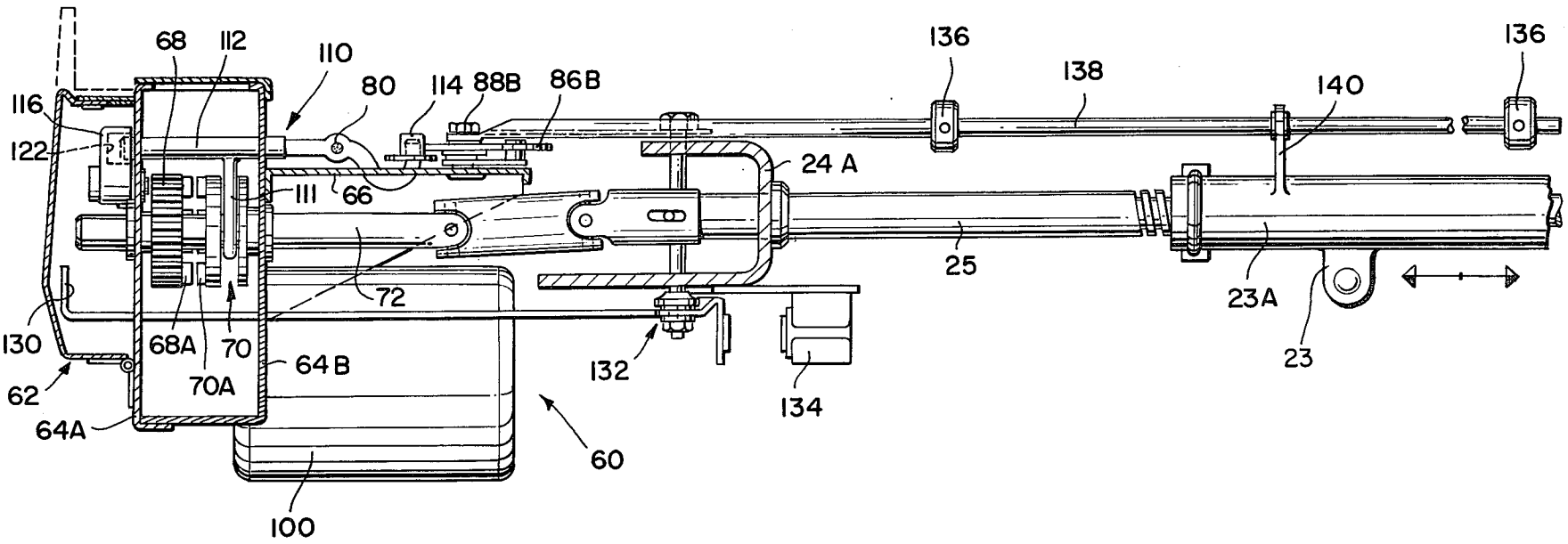
FIG. 9 is a cross sectional view taken along lines 9—9 of FIG. 8 and showing additional details. Som parts have been removed to make the illustration clear.

In this regard, while magnetic catch 134 holds connecting rod 138 against reverse movement under the pulling force of guide member 140 until the appropriate stop 136 is contacted for automatic deenergizing of motor 100 when the frame 24 reaches the low position, on the other hand, as a safety measure the operation for achieving high position of the frame 24 requires constant manual pull on control lever 130 by the nurse or other attendant against the pulling force of such guide member 140 in the corresponding opposite direction as elongate tubing 23A travels in that direction (to the left as viewed in FIG. 9). Otherwise, guide member 140 will pull connecting rod 138 under sliding frictional force along therewith and automatically immediately return cam 86B to neutral position to deenergize motor 100.

Generally, therefore, the high and low adjustment arrangement is such that it will automatically lock out motor 100 when the bed frame 24 reaches the apex of the high or the depth of the low position, if not earlier accomplished by the sliding frictional force between guide member 140 and connecting rod 138 where the pull on control lever 130 is relaxed in the case of high position adjustment.

It is to be understood that the shock and drainage position for the bed frame 24 may be carried out in a manual fashion by a retractable manual crank of the usual kind (not shown) which is disposed on the nurse control console 62. Provision for automatic lock out of motor 100 during this time may be made in the conventional manner as desired, e.g. by opening master safety switch 96C or otherwise.

The pertinent operation may be generally described as follows:

The head section 16 or the foot or knee section 19 may be raised or lowered by moving the handles 40 or 42 about their respective pivot points 36A and 38A. For example, rotation of the handle 42 in the direction indicated by the arrow A in FIG. 1, will cause cam activating rod 44 to move in the direction indicated by arrow B in FIG. 2. The movement of the cam activating rod 44 will cause rotation of cam 86A about its pivot point 88A and in turn will move slide bar 94 to the direction indicated by the arrow C in FIG. 8. This movement will operate the corresponding contact of motor switch 96 to be activated by the spring loaded contact pin 108 mounted onto the slide bar 94.

By means of the corresponding yoke assembly 110, the foot or knee drive mechanism will be activated simultaneously through the clutch plate 70 connected to drive gear 68 which in turn rotates drive screw 17C. This draws cable 80 tautly at that point towards the gear drive 68 and simultaneously prevents operation during this period of cam 86B and cam 86C due to the non-extensible fixed length nature of such cable. This action causes the elongate tubing 17B to travel away from foot board 28 pushing head section 16 upwardly through link 17A and rotating it about its pivot point 15A. When rotation of the lever 42 is reversed, the head section 16 will be correspondingly lowered until the desired position is reached. Upon manual release of lever 42, spring 90 will cause cam 86A to return to neutral position.

The operation of handle 40 effects corresponding adjustment of the cam 86C for changing the disposition of the foot section 20, again while simultaneously preventing operation during this period of cam 86A and cam 86B.

Similarly, push or pull operation of control lever 130 effects corresponding adjustment of cam 86B for high or low adjustment of the frame 24, also while simultaneously preventing operation during this period of cam 86A and cam 86C.

The foregoing variations in the positions of the head section 16 and foot section 20 can only be achieved when the lockout knob 116 or 118 as the case may be, is positioned in its inoperative position and does not block axial movement of the corresponding yoke assembly 110. In other words, when the particular yoke assembly 110 is free to move axially laterally within the area 122 of the lock out knob 116 or 118, it allows the corresponding clutch plate 70 to be engaged with the drive gear 68 so that the entire section 16 or 20 will be raised or lowered in accordance with the direction of rotation of the motor 100. On the other hand, control lever 130 may be operated for high or low position adjustment regardless of the position of lock out knobs 116 and 118 so long as cable 80 is in normal untensioned position, i.e., not offset by otherwise movement of cam 86A or cam 86B. By this economic arrangement using only one motor, the aforesaid desired positions may be readily achieved selectively yet with appropriate overriding control safeguards.

Accordingly, as shown in FIGS. 5 and 6, the present invention provides effective, simpler means to lock out the patient's control remotely and prevent the operation of the head section 16 and foot or knee section 20 by such patient. In this regard, control lock out knobs 116 and 118 are conveniently pivotally mounted at the foot of the bed out of the reach of the patient on outer side wall 64A. The free end of the corresponding yoke assembly 110 is housed within the space provided in the particular lock out knob 116 or 118. This particular arrangement prevents in essence any undesired or inadvertent unlocking which might permit movement of the handles 32 and 34, or the rotation of cams 86A and 86C, and operation of the motor 100.

This is a distinct advantage of the present invention over the locking means usually used in the prior art, e.g. of the pushbutton type, which are merely moved upwardly and downwardly, and thus which may be inadvertently, accidentally or unintentionally activated, undermining the very purpose for which such control is provided. Also, such known locking means usually are located in position accessible to the patient who is not necessarily intended to operate the same under certain conditions. In any case, because such lock out bottom extend outwardly and can be very readily accidentally moved inwardly by an inadvertent action on the part of a nurse or hospital staff, their utility is questionable from a safety standpoint. On the other hand, with the safety means provided according to the invention as between the patient control console 30 and the remote nurse control console 62, the engagement of more than one drive mechanism at a time is prevented as well unauthorized patient operation under certain conditions. As a consequence, inadvertent operation for positional adjustment of the instant bed will not take place.

It will, therefore, be understood that a very economic hospital bed which is capable of adjustment to a number of positions is provided with an absolute minimum of parts and with only one motor. Furthermore, only one drive mechanism can be operated at any one time in this efficient and economical arrangement.

Accordingly, a system for controlling selective relative positional movement of portions of a bed structure with respect to a main supporting bed base frame is contemplated herein, involving in combination, especially with respect to a hospital bed, a plurality of independently operable individual motion transmission means, e.g. including parts 17B and 17C, 19B and 19C, and 23A and 25, connectable to such portions of the bed structure for correspondingly effecting the selective relative positional movement thereof with respect to the main supporting bed base frame; common drive transmission means, e.g. including parts 68, 70, 72, 74 and 76, for driving the motion transmission means; coupling means, e.g. including parts 70, for operatively coupling and uncoupling the individual motion transmission means with the common drive transmission means; and common uniselective control means or safety means, e.g. including parts 78 and 110, operatively connected to the coupling means for uniselectively actuating the coupling means.

In this way, utilizing only one motor connected to the common drive transmission means, the coupling means may be uniselectively actuated by the common uniselective control means, e.g. via cam action, for coupling the common drive transmission means with a selective individual motion transmission means for effecting such positional movement, while simultaneously preventing the coupling of the common drive transmission means with the remaining corresponding motion transmission means. Such system thereby controls the selective relative positional movement of the bed portions safely and with the use of only one common motor as the source of motive power, e.g. operable in alternative forward and reverse rotational directions under appropriate control switch means action for corresponding alternative forward and reverse motion transmission relative directional movement of the individual motion transmission means selected.

Preferably, the common uniselective control means includes a corresponding actuable selector means, e.g. including parts 86A, 86B and 86C, for each individual motion transmission means having in turn a displaceable selector member, e.g. including parts 111 and 112, operatively connected for actuating the coupling means. Appropriately, the displaceable members are commonly operatively interconnected for limited range actuating displacement of only one such member at a time for uniselectively actuating the coupling means. Such common interconnection is desirably provided in the form of a relatively non-extensible and substantially fixed selective length flexible linear tension adjustment element arrangement in a normal path, e.g. including parts 80, 82, 66A and 84, so as to permit limited flexing out of its normal path to an extent corresponding to the limited range actuating displacement of only one such member at a time.

As a salient feature of the invention, especially with regard to the safety aspects of mechanical movement of parts of a hospital bed or the like containing a patient therein, remote override control means are provided which are arranged operatively for selectively preventing the actuating of the coupling means by the common uniselective control means, e.g. at the instance of the patient, and for independently selectively controlling the actuation of the coupling means, e.g. including parts 116 and 118, and parts 130, 132, 133, and 86B conjunctively in relation to parts 78 and 110, e.g. at the instance of the nurse or other attendant.

It is to be understood that the foregoing description is merely to facilitate an understanding of the invention and not as a limitation upon the scope thereof. Variations and modifications may therefore be made without in any way departing from the spirit of the invention as defined in the appended claims.

What is claimed is:

1. System for controlling selective relative positional movement of portions of a bed structure with respect to a main supporting bed base frame which comprises:

a plurality of independently operable individual motion transmission means connectable to such portions of the bed structure for correspondingly effecting the selective relative positional movement thereof with respect to the main supporting bed base frame, common drive transmission means for driving the motion transmission means, coupling means actuatable for operatively coupling and uncoupling the individual motion transmission means with the common drive transmission means, and common uniselective control means operatively connected to the coupling means for uniselectively actuating the coupling means for coupling the common drive transmission means with a selective individual motion transmission means and for simultaneously preventing the coupling of the common drive transmission means with the remaining corresponding motion transmission means, said common uniselective control means including a common flexible linear tension means operatively interconnected with the coupling means for limited range actuating displacement for controlling the coupling of such common drive transmission means with only one such motion transmission means at a time, whereby to control such selective relative positional movement.

2. System according to claim 1 wherein the common uniselective control means includes a corresponding actuatable selector means for each individual motion transmission means having in turn a displaceable selector member operatively connected for actuating the coupling means, the displaceable members being commonly operatively interconnected via the common flexible linear tension means for limited range actuating displacement of only one such member at a time for uniselectively actuating the coupling means.

3. System according to claim 2 wherein the common drive transmission means is operatively connectable to a common motor for driving the common drive transmission means and in turn the individual motion transmission means via the coupling means selectively in alternative forward and reverse motion transmission relative directions.

4. System according to claim 3 wherein switch means are provided which are operatively connectable to such common motor and commonly controlled by the actuation of each selector means for driving the corresponding motion transmission means selectively in such alternative forward and reverse motion transmission relative directions.

5. System according to claim 2 wherein the displaceable members are commonly interconnected by a relatively non-extensible and substantially fixed length flexible linear tension adjustment element arranged in a normal path to permit limited flexing out of its normal path to an extent corresponding to the limited range actuating displacement of only one such member at a time.

6. System according to claim 1 wherein remote override control means are provided which are arranged operatively for selectively preventing the actuating of the coupling means by the common uniselective control means and for independently selectively controlling the actuation of the coupling means.

7. System for controlling selective relative positional movement of portions of a bed structure with respect to a main supporting bed base frame which comprises:

a single common motor controllable for driving operation selectively in alternative forward and reverse directions, common drive transmission means connected to the common motor for corresponding operation thereby in such directions, a plurality of independently operable individual motion transmission means capable of being driven selectively in concordant alternative forward and reverse motion transmission relative directions in accordance with the operation of the common motor and connectable to such portions of the bed structure for correspondingly effecting the selective relative positional movement thereof with respect to the main supporting bed base frame, coupling means actuatable for operatively coupling and uncoupling the individual motion transmission means with the common drive transmission means and in turn the common motor for corresponding operation thereby in such directions, and common uniselective control means operatively connected to the coupling means for uniselectively actuating the coupling means for coupling the common drive transmission means with a selective individual motion transmission means and for simultaneously preventing the coupling of the common drive transmission means with the remaining corresponding motion transmission means, said common uniselective control means including a common flexible linear tension means operatively interconnected with the coupling means for limited range actuating displacement for controlling the coupling of such common drive transmission means with only one such motion transmission means at a time, whereby to control such selective relative positional movement.

8. System according to claim 7 wherein the common uniselective control means includes a corresponding actuatable selector means for each individual motion transmission means having in turn a displaceable selector member operatively connected for actuating the coupling means, the displaceable members being commonly operatively interconnected via the common flexible linear tension means for limited range actuating displacement of only one such member at a time for uniselectively actuating the coupling means.

9. System according to claim 8 wherein switch means are provided which are operatively connected to such common motor and commonly controlled by the actuation of each selector means for driving the corresponding motion transmission means selectively in such alternative forward and reverse motion transmission relative directions.

10. System according to claim 8 where the displaceable members are commonly interconnected by a relatively non-extensible and substantially fixed length flexible linear tension adjustment element arranged in a normal path to permit limited flexing out of its normal path to an extent corresponding to the limited range actuating displacement of only one such member at a time.

11. System according to claim 10 wherein remote override control means are provided which are arranged operatively for selectively preventing the actuating of the coupling means by the common uniselective control means and for independently selectively controlling the actuation of the coupling means.

* * * * *